US010774290B2

(12) United States Patent
Caparrós Casco

(10) Patent No.: US 10,774,290 B2
(45) Date of Patent: Sep. 15, 2020

(54) DETERGENT COMPOSITION IN THE FORM OF AN EFFERVESCENT TABLET

(71) Applicant: Lorena Martí Coma, Barcelona (ES)

(72) Inventor: Jordi Caparrós Casco, Barcelona (ES)

(73) Assignee: Lorena Martí Coma, Barcelona (ES)

( * ) Notice: Subject to any disclaimer, the term of this patent is extended or adjusted under 35 U.S.C. 154(b) by 0 days.

(21) Appl. No.: 15/556,716

(22) PCT Filed: Mar. 9, 2016

(86) PCT No.: PCT/ES2016/070149
§ 371 (c)(1),
(2) Date: Sep. 8, 2017

(87) PCT Pub. No.: WO2016/142565
PCT Pub. Date: Sep. 15, 2016

(65) Prior Publication Data

US 2018/0105766 A1 Apr. 19, 2018

(30) Foreign Application Priority Data

Mar. 12, 2015 (ES) ..... 201530321

(51) Int. Cl.

| | |
|---|---|
| ***C11D 1/12*** | (2006.01) |
| ***C11D 1/14*** | (2006.01) |
| ***C11D 3/10*** | (2006.01) |
| ***C11D 3/20*** | (2006.01) |
| ***C11D 3/22*** | (2006.01) |
| ***C11D 17/00*** | (2006.01) |
| ***C11D 3/32*** | (2006.01) |
| ***C11D 3/00*** | (2006.01) |
| ***C11D 11/00*** | (2006.01) |

(52) U.S. Cl.
CPC ..... *C11D 1/146* (2013.01); *C11D 3/0052* (2013.01); *C11D 3/10* (2013.01); *C11D 3/2086* (2013.01); *C11D 3/22* (2013.01); *C11D 3/222* (2013.01); *C11D 3/225* (2013.01); *C11D 3/323* (2013.01); *C11D 11/0017* (2013.01); *C11D 11/0023* (2013.01); *C11D 17/0047* (2013.01); *C11D 17/0073* (2013.01)

(58) Field of Classification Search
None
See application file for complete search history.

(56) References Cited

U.S. PATENT DOCUMENTS

| | | | | |
|---|---|---|---|---|
| 4,181,621 | A * | 1/1980 | Raaf | C11D 3/323 134/2 |
| 5,741,520 | A | 4/1998 | DeSenna | |
| 2004/0058843 | A1 | 3/2004 | Del Nunzio et al. | |
| 2004/0223921 | A1* | 11/2004 | Rau | A61K 8/19 424/49 |
| 2006/0019860 | A1* | 1/2006 | Cardozo | C11D 3/225 510/445 |
| 2007/0191251 | A1* | 8/2007 | Geny | C11D 1/24 510/424 |
| 2013/0338053 | A1* | 12/2013 | Casco | C11D 1/146 510/214 |

FOREIGN PATENT DOCUMENTS

| | | |
|---|---|---|
| EP | 2626408 | 8/2013 |
| WO | 00/22085 | 4/2000 |
| WO | 2005/061689 | 7/2005 |

OTHER PUBLICATIONS

International Search Report for International Application No. PCT/ES2016/070149, dated May 31, 2016.
Written Opinion of the International Searching Authority for International Application No. PCT/ES2016/070149, dated May 31, 2016.

* cited by examiner

*Primary Examiner* — Lorna M Douyon
(74) *Attorney, Agent, or Firm* — Staas & Halsey LLP

(57) ABSTRACT

A detergent composition in the form of an effervescent tablet having high dissolution rate and good stability, which is suitable for producing aqueous solutions of cleaning compositions for cleaning hard surfaces and clothes. The tablet includes an alkylsulfate-type anionic surfactant, an effervescent system, a combination of at least two disintegrating agents, and urea.

12 Claims, No Drawings

DETERGENT COMPOSITION IN THE FORM OF AN EFFERVESCENT TABLET

Cross-Reference to Related Applications

This application is a U.S. National Stage Application, which claims the benefit under 35 U.S.C. § 371 of PCT International Patent Application No. PCT/ES2016/070149, filed Mar. 9, 2016, which claims the foreign priority benefit under 35 U.S.C. § 119 of Spanish Patent Application No. P201530321, filed Mar. 12, 2015, the contents of which are incorporated herein by reference.

FIELD OF THE INVENTION

The present invention relates to a detergent composition in the form of an effervescent tablet which is suitable for use in the domestic and industrial sector both for cleaning hard surfaces and clothes.

PRIOR ART

Detergent and cleaning product compositions are commercially available in the form of solid and liquid products.

A growing trend in liquid product consumption has been observed in the domestic sector. This involves transporting significant amounts of water, as well as using many plastic containers that must be recycled. This phenomenon has clearly been observed in the field of detergent powders for washing clothes, in which a significant reduction in powdered product consumption has been noticed, with a shift towards liquid products.

Detergent compositions in the form of tablets offer advantages with respect to liquid and solid compositions, because they are more cost-effective in terms of transport and storage as they are compressed and do not contain water. Furthermore, they make correct metering easier and do not cause any problems relating to powder being given off, when used. In order for said compositions to be well received by consumers, the tablets must disintegrate quickly as they contact water, thereby obtaining the detergent composition.

Detergent or cleaning compositions in the form of effervescent tablets having advantages, such as the ease of handling, metering, transport and storage, and a quick active component solubilization, have also been described in the state of the art. However, said compositions failed to prevail on the market despite the mentioned advantages. Some of the reasons for this may be due to the relatively complex manufacturing method which requires specific environmental conditions and must take into account the possible presence of unwanted interactions between the components. There is also a need to find a compromise between the ease of disintegration and the mechanical strength of the tablet, which are two characteristics that are conflicting but must be met simultaneously. The formulation and stability thereof also poses a challenge, given that these systems are very sensitive to moisture both during manufacture and during storage.

In this sense, U.S. Pat. No. 5,114,647 describes effervescent tablets comprising chloroisocyanurate, as a disinfecting component. To achieve a good disintegration rate, a manufacturing method which comprises compressing and then crushing a mixture of an alkaline carbonate with a solid carboxylic acid, to which the disinfecting agent is added, is used. It is difficult to implement said method at an industrial scale.

International patent application WO-A-98/24873 describes tablets containing an effervescent and disintegrant system in the core and are coated with a coating to increase the stability thereof. The additional step of incorporating a coating causes the manufacturing method to be more complex than desired.

International patent application WO-A-93/08255 describes effervescent tablets comprising perfume and sorbitol as a vehicle.

European patent application EP-A-1134281 describes detergent tablets comprising a non-compressed phase, in which components which are sensitive to compression are found, and a compressed phase, such that the washing process can be better controlled. Nevertheless, the method for manufacturing same is complex.

International patent applications WO-A-00/04117 and WO-A-00/04124 describe multi-phase detergent tablets, in which an effervescent system acting as a disrupting agent for the tablet is found in one of the phases. The preferred embodiments thereof also describe that the different phases are compressed at different pressures, thereby complicating the manufacturing method.

International patent applications WO-A-02/33037 and WO-A-00/33038 describe a detergent tablet for an automatic washing machine comprising a cross-linked polymeric disintegrating agent in combination with a disintegration retardant, and optionally includes an effervescent system. The preferred embodiments thereof also describe that the different phases are compressed at different pressures, thereby complicating the manufacturing method.

International patent application WO-A-02/086048 describes an effervescent tablet comprising a compound with germicidal properties and an effervescent agent formed by an acid component and a basic component. Nevertheless, they must be stored at a temperature lower than room temperature and a humidity of less than 20%.

International patent application WO-A-02/99026 describes a method for enhancing the dissolution of a solid material in a liquid involving the use of an effervescent system including an enzyme and a substrate for the enzyme to generate gas therefrom.

International patent application WO-A-03/062360 describes a detergent tablet including an effervescent system, polyethylene glycol and an organic compound with two polar groups, such as 1,6-hexanediol for improving the dissolution of the components of the formulation, for example.

International patent application WO-A-03/089650 describes an effervescent tablet including clay, an inorganic magnesium salt, and a sulfonated anionic surfactant.

International patent application WO-A-2005/061689 describes detergent tablets with a high perfume content, including an effervescent system, clay and sodium acetate as a solubility intensifier.

International patent application WO-A-2008/009804 describes a multilayer tablet comprising fragmentation layers between the product layers, comprising microcrystalline cellulose as a disintegrating agent. It also describes that the incorporation of the disintegrating agent in the same layer of the detergent components leads to a lower disintegration rate than if said disintegrating agent is found in a separate layer. The disintegration time is reduced from 9 to 5 minutes at 50° C. and under stirring, being a long time in both cases.

International patent application WO-A-2012/045907 describes compositions comprising between 20% and 30% by weight of sodium lauryl sulfate and an effervescent disintegrant adjuvant formed by citric acid and sodium carbonate or sodium bicarbonate.

International patent application WO-A-2014/013120 describes effervescent tablets comprising between 1% and 24% by weight of an ethoxylated alcohol. Said document does not provide any data concerning the tablet dissolution time.

Despite the technical solutions described in the state of the art, there is still a need for detergent compositions in the form of effervescent tablets that are easy to produce, disintegrate quickly, even in water at room temperature, and have a good resistance to environmental humidity.

Object of the Invention

The object of the present invention relates to a detergent composition in the form of an effervescent tablet.

Another object of the invention relates to a method for producing said tablet.

Another object of the invention relates to the use of said tablet for producing an aqueous detergent solution.

DETAILED DESCRIPTION OF THE INVENTION

The object of the present invention relates to a detergent composition in the form of an effervescent tablet comprising:

a) an alkylsulfate-type anionic surfactant having a linear or branched $C_{8-18}$ alkyl chain in the form of sodium, potassium, ammonium, monoethanolammonium, diethanolammonium or triethanolammonium salt, b) an effervescent system formed by a water-soluble organic acid and an inorganic salt selected from the group formed by an alkaline carbonate, an alkaline bicarbonate, and mixtures thereof, c) a disintegrant system comprising a combination of at least two disintegrating agents selected from the group formed by starch, pregelatinized starch, sodium starch glycolate, and sodium carboxymethyl cellulose, and d) urea.

The authors of the present invention have developed a detergent composition in the form of an effervescent tablet which surprisingly disintegrates almost immediately in contact with water, has a good structural strength and stability even in the absence of protection against humidity.

The tablets of the invention, in addition to having a high disintegration and solubilization rate, do not leave any residue in the vessel in which they are dissolved, such that all the active components are homogenously dissolved in the aqueous phase.

In the context of the invention, the term "tablet" is a synonym of "pellet", as both terms are used interchangeably in the sector.

In the present description, as well as in the claims, the singular forms "a", "an" and "the" include the plural reference unless otherwise clearly indicated by the context.

Anionic Surfactant

An alkylsulfate-type anionic surfactant having a linear or branched $C_{8-18}$ alkyl chain in the form of sodium, potassium, ammonium, monoethanolammonium, diethanolammonium or triethanolammonium salt is used in the composition of the invention.

It is preferably an alkylsulfate having a linear $C_{12-14}$ alkyl chain or a branched $C_{11-15}$ alkyl chain, more preferably an alkylsulfate having a linear $C_{12-14}$ alkyl chain or a linear $C_{12}$ alkyl chain and even more preferably the sodium salt of an alkylsulfate having a linear $C_{12-14}$ alkyl chain or a linear $C_{12}$ alkyl chain.

Alkylsulfate-type surfactants can be found on the market, for example, under the Texapon® (BASF) or Empicol® (Huntsman) brand name.

In the composition of the invention, the anionic surfactant content is usually comprised between 2% and 20% by weight with respect to the total weight of components a) to d), preferably between 3% and 15%, and more preferably between 4% and 10%.

Effervescent System

The composition of the invention comprises an effervescent system for the disintegration of the tablet when contacting an aqueous solution.

Said effervescent system is formed by a water-soluble organic acid and an inorganic salt selected from the group formed by an alkaline carbonate, an alkaline bicarbonate, and mixtures thereof.

The water-soluble organic acid is preferably selected from citric acid, malic acid, tartaric acid, malonic acid, maleic acid, succinic acid, and mixtures thereof, preferably citric acid, tartaric acid, and mixtures thereof, even more preferably citric acid. These acids can be used in the anhydrous form, hydrated form, or in the form of partial salts thereof, such as potassium bitartrate, for example. In a more preferred embodiment, the water-soluble organic acid is anhydrous citric acid.

The water-soluble organic acid content is generally comprised between 10% and 45% by weight with respect to the total weight of components a) to d), preferably between 12% and 40%, and more preferably between 15% and 35%.

The inorganic salt which is part of the effervescent system is selected from the group formed by an alkaline carbonate, an alkaline bicarbonate, and mixtures thereof.

The alkaline cation is preferably selected from lithium, sodium and potassium, more preferably sodium and potassium, and even more preferably sodium. More preferably, a mixture of sodium carbonate and sodium bicarbonate is used.

The inorganic salt content is usually comprised between 15% and 45% by weight with respect to the total weight of components a) to d), preferably between 20% and 40%, and more preferably between 25% and 35%.

In case of using a mixture of carbonate and bicarbonate, the sodium bicarbonate:sodium carbonate weight ratio is comprised between 20:1 and 1:20, preferably between 18:1 and 1:10, even more preferably between 6:1 and 1:5, and even more preferably between 3:1 and 1:3. In case of using a different salt, the weight ratio between said salts can easily be calculated.

In a particularly preferred embodiment, the effervescent system is formed by anhydrous citric acid and a mixture of sodium carbonate and sodium bicarbonate.

In a particularly preferred embodiment, the composition of the invention comprises the sodium salt of an alkylsulfate having a linear $C_{12-14}$ alkyl chain or a linear $C_{12}$ alkyl chain, and the effervescent system is formed by anhydrous citric acid and a mixture of sodium carbonate and sodium bicarbonate. More preferably, the anionic surfactant content is comprised between 4% and 10% by weight with respect to the total weight of components a) to d), the water-soluble organic acid content is comprised between 15% and 35% by weight with respect to the total weight of components a) to d), the inorganic salt content is comprised between 25% and 35% by weight with respect to the total weight of components a) to d), and the sodium bicarbonate:sodium carbonate weight ratio is comprised between 3:1 and 1:3.

Disintegrant System

The composition of the invention comprises a disintegrant system comprising a combination of at least two disintegrating agents selected from the group formed by starch, pregelatinized starch, sodium starch glycolate, and sodium carboxymethyl cellulose, preferably selected from the group formed by starch, pregelatinized starch, and sodium carboxymethyl cellulose, more preferably a combination of starch and sodium carboxymethyl cellulose.

The disintegrating agent content is usually comprised between 5% and 25% by weight with respect to the total weight of components a) to d), preferably between 8% and 20%, more preferably between 10% and 15%.

When using a combination of starch and sodium carboxymethyl cellulose, a starch:sodium carboxymethyl cellulose weight ratio comprised between 10:1 and 1:10 is preferably used, more preferably between 5:1 and 1:5, and even more preferably between 3:1 and 1:1. A particularly preferred starch:sodium carboxymethyl cellulose weight ratio is 1.7:1.

In a particularly preferred embodiment, the composition of the invention comprises the sodium salt of an alkylsulfate having a linear $C_{12-14}$ alkyl chain or a linear $C_{12}$ alkyl chain, the effervescent system is formed by anhydrous citric acid and a mixture of sodium carbonate and sodium bicarbonate, and the disintegrating agent is a combination of starch and sodium carboxymethyl cellulose. More preferably, the anionic surfactant content is comprised between 4% and 10% by weight with respect to the total weight of components a) to d), the water-soluble organic acid content is comprised between 15% and 35% by weight with respect to the total weight of components a) to d), the inorganic salt content is comprised between 25% and 35% by weight with respect to the total weight of components a) to d), the sodium bicarbonate:sodium carbonate weight ratio is comprised between 3:1 and 1:3, the disintegrating agent content is comprised between 10% and 15% by weight with respect to the total weight of components a) to d), and the starch: sodium carboxymethyl cellulose weight ratio is comprised between 3:1 and 1:1.

Urea

The composition of the invention comprises urea. The urea content is generally comprised between 5% and 25% by weight with respect to the total weight of components a) to d), preferably between 8% and 20%, and more preferably between 10% and 12%.

The combination of urea with the disintegrant system, preferably with the combination of starch and sodium carboxymethyl cellulose, leads to obtaining tablets with a high active component disintegration and solubilization rate.

In a particularly preferred embodiment, the composition of the invention comprises the sodium salt of an alkylsulfate having a linear $C_{12-14}$ alkyl chain or a linear $C_{12}$ alkyl chain, the effervescent system is formed by anhydrous citric acid and a mixture of sodium carbonate and sodium bicarbonate, the disintegrating agent is a combination of starch and sodium carboxymethyl cellulose, and urea. More preferably, the anionic surfactant content is comprised between 4% and 10% by weight with respect to the total weight of components a) to d), the water-soluble organic acid content is comprised between 15% and 35% by weight with respect to the total weight of components a) to d), the inorganic salt content is comprised between 25% and 35% by weight with respect to the total weight of components a) to d), the sodium bicarbonate:sodium carbonate weight ratio is comprised between 3:1 and 1:3, the disintegrating agent content is comprised between 10% and 15% by weight with respect to the total weight of components a) to d), the starch:sodium carboxymethyl cellulose weight ratio is comprised between 3:1 and 1:1, and the urea content is comprised between 10% and 12% by weight with respect to the total weight of components a) to d).

Other Components

The detergent composition in the form of an effervescent tablet is a versatile composition which allows incorporating other components in said basic composition to obtain compositions suitable, for example, for washing glassware, for reducing water hardness, for washing dishes manually and automatically, for providing glossiness to dishes automatically, for removing grease from hard surfaces (for example, extractor hoods, kitchens, glass-ceramic cooktops, induction cooktops), for cleaning hard surfaces (for example, ceramic flooring, tile flooring, parquet flooring, synthetic wood worktops, natural stone worktops, synthetic stone worktops, walls), for disinfecting hard surfaces (for example, floorings, toilets, bathtubs, sinks), for washing and softening clothes, or for descaling.

The additional components which can be added to the composition of the invention are selected from the components suitable for the intended use of the composition. The content of the additional components is generally comprised between 1% by weight and 50% by weight with respect to the total weight of the composition, such that the sum of all the components represents 100% of the composition.

Said additional components can be part of the same effervescent tablet in a single phase, or distributed in two or more phases. The disintegrant system is preferably included in a layer furthermore containing other detergent components.

In a preferred embodiment, the composition of the invention comprises at least one additional component selected from the group formed by surfactants, builders, alkaline agents, bleaching agents, bleaching activators, organic polymers, antiredeposition agents, descaling agents, foam regulators, color transfer inhibitors, thickening agents, enzymes, perfumes, and mixtures thereof.

Surfactants

The surfactants that can be used in the detergent composition of the invention can be selected, for example, from anionic surfactants (for example, soaps of carboxylic acids, alkylsulfonates, alkylarylsulfonates, linear alkylbenzenesulfonates, sulfosuccinates, sulfonated fatty acid esters, fatty acid isethionates, alkylethersulfates, alkylsulfates, alkylphosphates, alkyletherphosphates, acylglutamates, acylated peptides, acylsarcosinates), non-ionic surfactants (for example, ethoxylated fatty alcohol, ethylene oxide-propylene oxide copolymer, ethoxylated and propoxylated fatty alcohol, ethoxylated and propoxylated end capped fatty alcohol, alkylpolyglucosides, ethoxylated triglycerides, fatty acid alkanolamides, ethoxylated fatty acid alkanolamides, ethoxylated fatty acid esters, polyethylene glycol fatty esters, glycerin fatty esters, ethoxylated glycerin fatty esters, sorbitan fatty esters, ethoxylated sorbitan fatty esters, carbohydrate alkyl esters, alkylamine oxides, alkyldimethylamine oxides, amidoaminopropylamine oxides, ethoxylated alkylamines, ethoxylated-propoxylated alkylamines, ethoxylated alkylpropanodiamines, ethoxylated and propoxylated ethylenediamines), cationic surfactants (for example, tetraalkylammonium salts, tetraarylammonium salts, alkyltrimethylammonium salts, dialkyldimethylammonium salts, heterocyclic ammonium salts, quaternized triethanolamine fatty esters, quaternized methyldiethanolamine fatty esters), amphoteric surfactants (for example, alkylbetaine, alkylamidopropylbetaine, imidazolines, alkylamidopropylhydroxysultaine, acylamphomonoacetate, acylamphodiacetate, acylamphodipropionate, alkylaminopropionic acids, alkylglycinates, aminopropylalkylglutamides, alkyliminodipropionates), and mixtures thereof.

The person skilled in the art can find information relating to these surfactants, as well as to commercial sources thereof in a myriad of literatures published about surfactants, such as for example, in *Handbook of Industrial Surfactants,* Synapse Information Resources, Inc., 5$^{th}$ Edition, 2010 (ISBN-10:1934764418) by M. Ash, I. Ash.

The mentioned surfactants are commercially available, for example, through BASF, Huntsman, Stepan, Atochem, or Kao, since they are normally part of detergent compositions and/or cleaning products.

Builders

The builders that can be used in the detergent composition of the invention can be selected, for example, from sodium tripolyphosphate, tetrasodium pyrophosphate, zeolites, amorphous silicates, crystalline silicates, phosphonates (for example, ethane-1-hydroxydiphosphonate (HEDP), aminotris(methylenephosphonic) amino acid (ATMP), ethylenediaminetetramethylenephosphonates (EDTMP), diethylenetriaminepentamethylenephosphonates (DTPMP), nitrile trimethylenephosphonates (NTP), polymeric phosphonates), ethylenediaminetetraacetic acid (EDTA), hydroxyethylethylenediaminetriacetic acid (HEDTA), nitrilotriacetic acid (NTA), diethylenetriaminepentaacetic acid (DTPA), glutamic-N,N-diacetic acid, gluconates, dihydroxyethylglycine, methylglycinediacetic acid, succinates, tartrates, citrates, ethylenediaminesuccinic acid, and mixtures thereof.

The mentioned builders are commercially available since they are normally part of detergent and/or cleaning product compositions.

Alkaline Agents

The alkaline agents that can be used in the detergent composition of the invention can be selected, for example, from alkaline carbonates, alkaline bicarbonates, sodium hydroxide, potassium hydroxide, triethanolamine, and mixtures thereof.

The mentioned alkaline agents are commercially available, since they are normally part of detergent and/or cleaning product compositions.

Bleaching Agents and Bleaching Activators

The bleaching agents that can be used in the detergent composition of the invention can be selected, for example, from sodium percarbonate, sodium perborate monohydrate, sodium perborate tetrahydrate, calcium hypochlorite, dichloroisocyanurate, and chloramines. Tetraacetylethylenediamine (TAED), sodium nonanoyloxybenzenesulfonate (NOBS), sodium 3,5,5-trimethylhexanoylbenzenesulfonate or sodium isononanoyloxybenzenesulfonate (NOBS), tetraacetylglycolu ryl (TAGU), pentaacetylglucose (PAG), diacetyldioxohexahydrotriazine (DADHT), isatoic acid anhydride (ISA) can be used as bleaching activators, for example.

The mentioned bleaching agents are commercially available, for example, through Peroxychem, since they are normally part of detergent and/or cleaning product compositions.

The mentioned bleaching activators are commercially available, for example, through Clariant, since they are normally part of detergent and/or cleaning product compositions.

Organic Polymers

The organic polymers that can be used in the detergent composition of the invention can be selected, for example, from acrylic polymers, acrylic-maleic polymers, acrylic-maleic-vinyl polymers, polyamidocarboxylic acids, polyvinylpyrrolidone, cross-linked polyvinylpyrrolidone, and mixtures thereof.

The mentioned organic polymers are commercially available, for example, through BASF, since they are normally part of detergent and/or cleaning product compositions.

Antiredeposition Agents

The antiredeposition agents that can be used in the detergent composition of the invention can be selected, for example, from sodium carboxymethyl cellulose, methyl cellulose, hydroxypropylcellulose, polyethylene glycol, polyvinyl alcohol, aromatic and aliphatic dicarboxylic acid polyesters with ethylene glycol and/or propylene glycol, and mixtures thereof.

The mentioned antiredeposition agents are commercially available, for example, through JRS, since they are normally part of detergent and/or cleaning product compositions.

Descaling Agents

The descaling agents that can be used in the detergent composition of the invention can be selected, for example, from oxalic acid, sulfamic acid, sodium bisulfate, sodium bisulfite, monosodium orthophosphate, and mixtures thereof.

Foam Regulators

The foam regulators that can be used in the detergent composition of the invention can be selected, for example, from soaps, paraffins, polydimethylsiloxane, and mixtures thereof.

The mentioned foam regulators are commercially available, for example, through Dow Corning or Rhodia, since they are normally part of detergent and/or cleaning product compositions.

Color Transfer Inhibitors

The color transfer inhibitors that can be used in the detergent composition of the invention can be selected, for example, from homo- and copolymers of vinylpyrrolidone, vinylimidazole, vinyloxazolidone, 4-vinylpyridine-N-oxide, and mixtures thereof.

The mentioned color transfer inhibitors are commercially available, for example, through BASF, since they are normally part of detergent and/or cleaning product compositions.

Thickening Agents

The thickening agents that can be used in the detergent composition of the invention can be selected, for example, from guar gum, ethyl cellulose, xanthan gum, carbomers, carrageenans, chitosan, hydroxyethylcellulose, microcrystalline cellulose, high molecular weight solid polyethylene glycol, alginic acid, sodium alginate, calcium carboxymethyl cellulose, magnesium aluminum silicate, colloidal silicon dioxide, and mixtures thereof.

The mentioned thickening agents are commercially available, for example, through Ashland or Evonik, since they are normally part of detergent and/or cleaning product compositions.

Enzymes

The enzymes that can be used in the detergent composition of the invention can be selected from proteases, amylases, lipases, cellulases, and mixtures thereof.

The mentioned enzymes are commercially available, for example, through Novo Nordisk or Genencor, since they are normally part of detergent and/or cleaning product compositions.

Perfumes

As described above, perfume can also be included in the composition of the invention.

The Method

The composition of the invention can be produced by following methods well known by the person skilled in the art for producing tablets, such as, direct compression, for example.

The components in powdery form are gently mixed in a mixer and compacted in a tablet manufacturing machine by means of applying a compression force. To that end, the powdery composition of the different components is introduced in a housing of a rotary or eccentric press for tablets, for example, and the composition being compressed at a pressure comprised between 0.5 and 25 kN/cm$^2$, preferably between 1 and 10, and more preferably between 1 and 8. If the tablet includes two or more layers, each layer is obtained according to the described method, and one layer is compressed on top of the other.

The object of the invention relates to a method for producing the detergent composition in the form of an effervescent tablet, which method comprises the following steps:

1) mixing the components of the effervescent system, formed by a water-soluble organic acid and an inorganic salt selected from the group formed by an alkaline carbonate, an alkaline bicarbonate, and mixtures thereof,
2) mixing the alkylsulfate-type anionic surfactant having a linear or branched $C_{8-15}$ alkyl chain in the form of sodium, potassium, ammonium, monoethanolammonium, diethanolammonium or triethanolammonium salt, with urea,
3) adding the mixture obtained in step 2) to the mixture obtained in step 1),
4) mixing the components of the disintegrant system comprising a combination of at least two disintegrating agents selected from the group formed by starch, pregelatinized starch, sodium starch glycolate, amorphous cellulose, microcrystalline cellulose, sodium carboxymethyl cellulose, croscarmellose sodium, polyvinylpyrrolidone, and crospovidone,
5) adding the mixture obtained in step 4) to the mixture obtained in step 2), and
6) compressing the powdery mixture obtained in step 5).

If the composition includes additional components, these components are added to the mixture obtained in step 5).

Preferably in the method of the invention, the anionic surfactant is the sodium salt of an alkylsulfate having a linear $C_{12-14}$ alkyl chain or a linear $C_{12}$ alkyl chain, the effervescent system is formed by anhydrous citric acid and a mixture of sodium carbonate and sodium bicarbonate, and the disintegrating agent is a combination of starch and sodium carboxymethyl cellulose. More preferably, the anionic surfactant content is comprised between 4% and 10% by weight with respect to the total weight of components a) to d), mentioned above, the water-soluble organic acid content is comprised between 15% and 35% by weight with respect to the total weight of components a) to d), mentioned above, the inorganic salt content is comprised between 25% and 35% by weight with respect to the total weight of components a) to d), mentioned above, the sodium bicarbonate:sodium carbonate weight ratio is comprised between 3:1 and 1:3, the disintegrating agent content is comprised between 10% and 15% by weight with respect to the total weight of components a) to d) mentioned above, the starch:sodium carboxymethyl cellulose weight ratio is comprised between 3:1 and 1:1, and the urea content is comprised between 10% and 12% by weight with respect to the total weight of components a) to d), mentioned above.

If the composition includes a liquid component such as perfume or non-ionic liquid surfactant, for example, this component can be incorporated by spraying on the mixture of solid components. It is preferably incorporated in solid form to the mixture obtained previously. To that end, the liquid component can be mixed with a combination of precipitated amorphous silica and starch in a weight proportion comprised between 10:1 and 1:10, preferably between 1:1 and 1:10, more preferably between 1:1 and 1:5, and even more preferably between 1:1 and 1:3, in order to obtain a powdery product having a good fluidity for the incorporation thereof to the mixture formed by the rest of the solid components. The content of the liquid component with respect to the mixture of silica and starch is generally comprised between 25% and 75% by weight, preferably between 30% and 60% by weight, more preferably between 45% and 55% by weight, and even more preferably 50% by weight. In this more preferred embodiment, one part of liquid is used per part of mixture of precipitated amorphous silica and starch.

In a more preferred embodiment, once the solid composition with the liquid component incorporated therein is obtained, this composition is kept at room temperature between 1 and 30 days, preferably between 5 and 30 days, more preferably between 10 and 20 days, before being incorporated to the mixture formed by the rest of the solid components.

The tablets obtained according to the method of the invention are resistant to fragmentation and abrasion.

The tablets obtained with the method of the invention generally have a weight comprised between 5 and 250 grams, preferably between 5 and 50 grams, more preferably between 5 and 25 grams, and even more preferably between 5 and 10 grams.

Once obtained, the tablets can be packaged into different types of container, such as blister pack, flow pack, plastic packaging, aluminum packaging, for example.

Under normal conditions, the tablets of the invention are stable without having to be packaged and do not lose efficiency. Although the tablets of the invention are preferably packaged, in order to favor the presentation thereof to users and to maintain their performances in the face of any possible event occurring due to environmental conditions with long periods of high humidity.

Use of the Tablet

Another object of the invention relates to the use of the tablet of the invention for producing an aqueous detergent solution.

As described above, the incorporation of specific components to the basic composition of the tablet allows obtaining compositions suitable, for example, for washing glassware, for reducing water hardness, for washing dishes manually and automatically, for providing glossiness to dishes automatically, for removing grease from hard surfaces (for example, extractor hoods, kitchens, glass-ceramic cooktops, induction cooktops), for cleaning hard surfaces (for example, ceramic flooring, tile flooring, parquet flooring, synthetic wood worktops, natural stone worktops, synthetic stone worktops, walls), for disinfecting hard surfaces (for example, floorings, walls, toilets, bathtubs, sinks), for washing and softening clothes, for descaling.

In particular, the tablet of the invention is used for producing an aqueous detergent solution for washing glassware, for reducing water hardness, for washing dishes manually and automatically, for providing glossiness to dishes automatically, for removing grease from hard surfaces, for cleaning hard surfaces, for disinfecting hard surfaces, for washing and softening clothes, and for descaling.

The tablet of the invention surprisingly has a good structural strength against fragmentation and abrasion, disintegrates almost immediately in contact with water, even in water at room temperature, and has a good stability even in the absence of protection against humidity, without losing efficiency.

It furthermore has a cleaning efficiency similar to commercial products.

The metering of the tablet of the invention depends on the type of dirt to be removed.

A tablet with a weight comprised between 5 and 10 grams is generally used in a volume of water comprised between 0.5 liters and 10 liters, preferably between 0.75 liters and 5 liters. In the event of hard-to-remove dirt, additional tablets can be added to increase the concentration of active components in the aqueous cleaning solution.

For industrial cleaning, larger tablets can be used in a larger volume of water, taking into account the proportions mentioned above.

Some examples for illustrating the present invention are included below, although they must not be considered as limiting it.

EXAMPLES

Example 1

Effervescent Tablet for Cleaning Glassware 1.4 kg of anhydrous sodium bicarbonate, 0.6 kg of sodium carbonate and 2.15 kg of citric acid, making up the effervescent system, were mixed.

0.35 kg of sodium lauryl sulfate and 0.8 kg of urea were mixed, and once obtained a homogeneous mixture was added to the effervescent system produced before and gently mixed. 0.25 kg of sodium carboxymethyl cellulose, 0.4 kg of starch and 0.2 kg of perfume were added to the obtained mixture and gentle mixing of the mixture continued.

The mixture was compressed at a pressure comprised between 1 and 3 kN/cm$^2$ in an eccentric tablet-manufacturing machine, BE-30 (J. Bonals, Spain), to obtain tablets weighing 6 grams each.

The obtained tablet was added to 750 ml of water and a detergent composition suitable for cleaning glassware was obtained. The tablet was dissolved between 15" and 30" in water at room temperature.

Example 2

Effervescent Tablet for Reducing Water Hardness

Following a method similar to that of Example 1, tablets comprising 1.2 grams of citric acid, 1.2 grams of oxalic acid, 1.6 grams of anhydrous sodium bicarbonate, 0.55 grams of sodium carbonate, 0.6 grams of sodium lauryl sulfate, 0.8 grams of urea, 0.4 grams of carboxymethyl cellulose, 0.45 grams of starch and 0.2 grams of perfume, were produced.

One of the obtained tablets was added to 750 ml of water and a detergent composition suitable for reducing water hardness was obtained. The tablet was dissolved between 15" and 30" in water at room temperature.

Example 3

Effervescent Tablet for Removing Grease

Following a method similar to that of Example 1, tablets comprising 1.2 grams of citric acid, 0.6 grams of anhydrous sodium bicarbonate, 1.5 grams of sodium carbonate, 0.35 grams of sodium lauryl sulfate, 0.8 grams of urea, 0.4 grams of carboxymethyl cellulose, 0.5 grams of starch, 0.15 grams of EDTA $Na_2$, 1.3 grams of sodium metasilicate, 0.5 grams of sodium hydroxide and 0.2 grams of perfume, were produced.

One of the obtained tablets was added to 750 ml of water and a detergent composition suitable for removing grease from hard surfaces was obtained. The tablet was dissolved between 15" and 30" in water at room temperature.

Example 4

Effervescent Tablet for Cleaning Hard Surfaces

Following a method similar to that of Example 1, tablets comprising 2.1 grams of citric acid, 1.6 grams of anhydrous sodium bicarbonate, 0.55 grams of sodium carbonate, 0.55 grams of sodium lauryl sulfate, 0.8 grams of urea, 0.35 grams of carboxymethyl cellulose, 0.6 grams of starch, 0.65 grams of coco diethanolamide and 0.2 grams of perfume, were produced.

One of the obtained tablets was added to 5 liters of water and a detergent composition suitable for cleaning hard surfaces was obtained. The tablet was dissolved between 15" and 30" in water at room temperature.

Example 5

Effervescent Tablet Application Tests

Following a method similar to that of Example 1, 8 types of tablets weighing 6 grams/tablet were produced according to a $2^3$ factorial design, with the factors and levels shown in Table I:

TABLE I

| Factor | Level− | Level+ |
|---|---|---|
| Urea | No | Yes |
| Starch | No | Yes |
| CMCNa | No | Yes |

The percentage composition of these three components in the tablets is shown in Table II:

TABLE II

| Example | Urea | Starch | CMCNa |
|---|---|---|---|
| 5.1 | 12 | 8 | 5 |
| 5.2 | 0 | 8 | 5 |
| 5.3 | 12 | 0 | 5 |
| 5.4 | 0 | 0 | 5 |
| 5.5 | 12 | 8 | 0 |
| 5.6 | 0 | 8 | 0 |
| 5.7 | 12 | 0 | 0 |
| 5.8 | 0 | 0 | 0 |

The anionic surfactant content, i.e., the sodium lauryl sulfate content, was %, whereas the citric acid, sodium bicarbonate and sodium carbonate contents were adjusted in each case so that the total of the components was 100%. Therefore, the citric acid content was comprised between 37% and 46% by weight, the sodium bicarbonate content was comprised between 25% and 33% by weight, and the sodium carbonate content was comprised between 8% and 16% by weight with respect to the total weight of the composition.

The obtained tablets were assessed with respect to three parameters: R1, R2 and R3, corresponding respectively to the structural strength of the tablet, the disintegration of the tablet in water, and the stability of the tablet against temperature and humidity, determined in triplicate.

The structural strength of the tablet was qualitatively assessed after subjecting different parts of the tablet to shearing forces. The tablet was considered to have a good structural strength if it withstood the different stresses.

The disintegration of the tablet was assessed by observing said disintegration in a vessel with 500 ml of water at room temperature (20° C. to 22° C.) and without stirring. If the disintegration was complete at a maximum time of 30", a high disintegration assessment was made.

The stability of the tablet against environmental humidity was assessed 2 months after a tablet as such, i.e., without any protection against humidity whatsoever, was exposed to a temperature comprised between 25° C. and 30° C. and under a relative humidity comprised between 50% and 80%. If the tablet remained the same without any reaction being observed between the components of the effervescent system, a high stability assessment was made.

Table III shows the array of the 8 conducted tests, showing the three tested factors and the obtained results:

TABLE III

| Example | Urea | Starch | CMCNa | R1 | R2 | R3 |
|---|---|---|---|---|---|---|
| 5.1 | Yes | Yes | Yes | Good | High | High |
| 5.2 | No | Yes | Yes | Regular-Good | Low | Regular-high |
| 5.3 | Yes | No | Yes | Poor | Low | Low |
| 5.4 | No | No | Yes | Poor | Low | Low |
| 5.5 | Yes | Yes | No | Regular | Regular | Low |
| 5.6 | No | Yes | No | Regular | Low | Low |
| 5.7 | Yes | No | No | Poor | Low | Low |
| 5.8 | No | No | No | Poor | Low | Low |

It can be observed that only the combination of urea with the disintegrant system, formed, in this case, by the combination of starch and sodium carboxymethyl cellulose, results in tablets that comply with the requirements relating to structural stability, quick disintegration in water, and stability against humidity

Example 6

Testing a Tablet for Cleaning Glassware

A tablet produced in Example 1 was dissolved in 750 ml of water with a hardness of 25° F.

A commercial glassware liquid cleaning product was used in the same test.

The efficiency of both products for cleaning an oil stain deposited on a piece of glassware was assessed in the test.

To produce said stain, fatty acids, lard, triglycerides, lanolin cholesterol, a mixture of hydrocarbons were mixed and the stain was deposited on a piece of glassware. After a drying process at room temperature, the piece of glassware was placed in an automatic apparatus which allows simulating cleaning with a piece of cloth where the product to be tested is applied.

The cleaning efficiency was characterized by visually evaluating the amount of dirt removed, using to that end a scale of 1 to 5, wherein 1 corresponds to no dirt being removed, 2 corresponds to a little dirt being removed, 3 corresponds to half the dirt being removed, 4 corresponds to most of the dirt being removed, and 5 corresponds to all the dirt being removed.

The tests were conducted in triplicate, and a score of 4 corresponding to most of the dirt being removed was obtained for both products.

The effervescent tablet of the invention therefore has a glassware cleaning efficiency comparable to that of a commercial product.

Example 7

Testing a Tablet for Washing Hard Surfaces

A tablet produced in Example 4 was dissolved in 5 liters of water with a hardness of 25° F.

A commercial flooring liquid cleaning product was used in the same test at a proportion of 50 ml per 5 liters of water.

The efficiency of both products for cleaning an oil stain deposited on a stainless steel sheet was assessed in the test.

To produce said stain, butter, lard, margarine, ketchup and an egg were mixed and the stain was deposited on a stainless steel sheet. After a drying process at a temperature of 105° C., the sheet was submerged in a bath comprising the product at a temperature of 50° C. The vessel was stirred for 2 minutes with an orbital stirrer to allow simulating the cleaning action. It was then rinsed with water and dried again in the oven.

The cleaning efficiency was characterized by weighing the sheet before and after cleaning, and determining the amount of stain being removed.

The tests were conducted in triplicate, and a 14% removal was obtained for the effervescent tablet of the invention, with a standard deviation of 1%, and a 10% removal was obtained for the commercial product, with a standard deviation of 0%.

The effervescent tablet of the invention therefore has a hard surface cleaning efficiency slightly greater than that of a commercial product.

The foaming power of the effervescent tablet of the invention was also determined according to the UNE standard 55-502-89, based on measuring the volume of foam obtained when a solution of the sample is allowed to fall from a specific height at 30", 3' and 5'.

Table IV shows the volume of foam, expressed in ml, at different times for the tablet of the invention and for the commercial flooring cleaning product:

TABLE IV

| Time | Tablet Example 4 | Commercial flooring cleaning product |
|---|---|---|
| 30" | 282 | 254 |
| 3' | 266 | 240 |
| 5' | 258 | 228 |

It can be observed that the tablet of the invention generates a large amount of foam and remains substantially constant over time. Said foaming power is slightly greater than that of the tested commercial product.

The invention claimed is:

1. A detergent composition in the form of an effervescent tablet comprising:

a) an alkylsulfate anionic surfactant having a linear or branched $C_{8-18}$ alkyl chain in a form of sodium, potassium, ammonium, monoethanolammonium, diethanolammonium or triethanolammonium salt, b) an effervescent system comprising a water-soluble organic acid and an inorganic salt selected from the group consisting of an alkaline carbonate, an alkaline bicarbonate, and mixtures thereof, c) a disintegrating agent comprising a combination of 8%, by weight, of starch and 5%, by weight, of sodium carboxymethyl cellulose, with respect to a total weight of the components a) to d), and d) 12%, by weight, of urea with respect to the total weight of the components a) to d).

2. The detergent composition according to claim 1, wherein the alkylsulfate anionic surfactant is a sodium salt of an alkylsulfate having a linear $C_{12-14}$ alkyl chain or a linear $C_{12}$ alkyl chain.

3. The detergent composition according to claim 1, wherein a content of the alkylsulfate anionic surfactant is between 2% and 20% by weight with respect to the total weight of the components a) to d).

4. The detergent composition according to claim 1, wherein the water-soluble organic acid is anhydrous citric acid.

5. The detergent composition according to claim 1, wherein the water-soluble organic acid is between 10% and 45% by weight with respect to the total weight of the components a) to d).

6. The detergent composition according to claim 1, wherein the effervescent system comprises a mixture of sodium carbonate and sodium bicarbonate.

7. The detergent composition according to claim 6, wherein a weight ratio of the sodium bicarbonate: the sodium carbonate is between 20:1 and 1:20.

8. The detergent composition according to claim 1, wherein an amount of the inorganic salt is between 15% and 45% by weight with respect to the total weight of the components a) to d).

9. The detergent composition according to claim 1, wherein the effervescent system comprises anhydrous citric acid and a mixture of sodium carbonate and sodium biocarbonate.

10. The detergent composition according to claim 1, wherein the alkylsulfate anionic surfactant is a sodium salt of an alkylsulfate having a linear $C_{12}$-14 alkyl chain or a linear $C_{12}$ alkyl chain, and the effervescent system consists of anhydrous citric acid and a mixture of sodium carbonate and sodium bicarbonate.

11. The detergent composition according to claim 10, wherein an amount of the alkylsulfate anionic surfactant is between 4% and 10% by weight with respect to the total weight of the components a) to d), an amount of the water-soluble organic acid is between 15% and 35% by weight with respect to the total weight of the components a) to d), an amount of the inorganic salt is between 25% and 35% by weight with respect to the total weight of the components a) to d), and a weight ratio of the sodium bicarbonate: the sodium carbonate is between 3:1 and 1:3.

12. The detergent composition according to claim 1, further comprising at least one additional component selected from the group consisting of surfactants, builders, alkaline agents, bleaching agents, bleaching activators, organic polymers, antiredeposition agents, descaling agents, foam regulators, color transfer inhibitors, thickening agents, enzymes, perfumes, and mixtures thereof.

* * * * *